United States Patent [19]

Hutt

[11] Patent Number: 4,897,968

[45] Date of Patent: Feb. 6, 1990

[54] INFLATABLE GRINDING ROLLER

[76] Inventor: Heinz Hutt, 472 Place Closse, Ile Bizard, Quebec, Canada, H9C 1Y6

[21] Appl. No.: 249,493

[22] Filed: Sep. 26, 1988

[51] Int. Cl.[4] ..... B24D 9/02

[52] U.S. Cl. ..... 51/373; 51/141

[58] Field of Search ..... 51/141, 170 EB, 358, 51/363, 372, 373, 381

[56] References Cited

U.S. PATENT DOCUMENTS

| | | | |
|---|---|---|---|
| 1,444,314 | 2/1923 | Herder | 51/373 |
| 2,017,163 | 10/1935 | Reed | 51/373 |
| 2,505,680 | 4/1950 | Mall | 51/373 |
| 2,601,048 | 6/1952 | Monger | 51/373 |
| 2,671,297 | 3/1954 | Arms | 51/373 X |
| 3,178,863 | 4/1965 | Mikiya | 51/373 |
| 3,496,685 | 2/1970 | Schmidt et al. | 51/373 |

OTHER PUBLICATIONS

Advertising Brochure (in German) entitled "Friweg", undated, Fritz Wegne GmbH & Co., Hamburg, Germany.

*Primary Examiner*—Robert P. Olszewski

*Attorney, Agent, or Firm*—Robic, Robic & Associates

[57] ABSTRACT

An inflatable grinding roller is disclosed which comprises an elastic sleeve tightly fitted over a hollow cylindrical support of which the center is concave so that the sleeve and support together define an inflatable air chamber. The concave section further has a bore section having a radial shoulder at its center so that angular corners are formed, which house packing rings. The ends of the sleeves are inturned over the ends of the support and clamped in position by skirts of a pair of cup-like plugs of which the flat bottoms have axial glands pressing the packing rings against the radial shoulder of the angular corners. A mandrel snuggly fits in the glands, the packing rings and the radial shoulder. It is blocked at one end against the bottom of one of the plugs while the other plug is forced against the first plug by a clamping mechanism. The mandrel has a blind bore communicating with the air chamber by passages through the mandrel, the randial shoulder and the bore section of the concave section. The open end of the blind bore has an inflation air check-valve.

14 Claims, 3 Drawing Sheets

INFLATABLE GRINDING ROLLER

BACKGROUND OF THE INVENTION

1. Field of the invention

The present invention relates to an improved inflatable grinding roller of the type comprising a cylindrical grinding belt fitted over an elastic sleeve supported by an air cushion, the roller being adapted for clamping in a chuck of a standard manual drill.

2. Description of the prior art

Inflatable grinding rollers of the above mentioned type are already known and have proven to be quite an exceptional development in grinding technology. Indeed, the air cushion upon which the grinding belt fits, makes the roller extremely more adaptable to any workpieces or to inaccessible faces of the workpieces, than conventional griding machines.

However, the existing rollers presently available on the market under the designation of "pneumatic belt sander or buffer" are complex to assemble and/or repair, due to the number of parts involved.

SUMMARY OF THE INVENTION

The object of the present invention is to provide an inflatable, roller for use to mount a cylindrical abrasive element, which has a more restricted number of parts, whereby its assembly is appreciably simplified, resulting also in a less expensive tool.

The improved roller according to the invention comprises an elastic sleeve tightly fitted over a hollow cylindrical support of which the center is concave so that the sleeve and support together define an inflatable air chamber. The concave section further has a bore section having a radial shoulder at its center so that angular corners are formed, which house packing rings. The ends of the sleeves are inturned over the ends of the support and clamped in position by skirts of a pair of cup-like plugs of which the flat bottoms have axial glands pressing the packing rings against the radial shoulder of the angular corners. A mandrel snuggly fits in the glands, the packing rings and the radial shoulder. It is blocked at one end against the bottom of one of the plugs while the other plug is forced against the first plug by a clamping mechanism. The mandrel has a blind bore communicating with the air chamber by passages through the mandrel, the radial shoulder and the bore section of the concave section. The open end of the blind bore has an inflation air check-valve.

According to an aspect of the invention, there is provided an inflatable roller, comprising: a hollow cylindrical sleeve support having a concave center section including a bore section provided, intermediate its ends, with an inner radial shoulder dividing the bore section into two angular corners; a packing ring in each of the corners; an elastic sleeve fitted over the support, the sleeve having ends inturned over the ends of the support; the sleeve and the concave section defining together an inflatable air chamber; a pair of cup-like compression members fitted into the ends of the support and constructed for pressing the sleeve inturned ends against the support; the members being formed, at their centers, with axial packing glands entering into the bore section and pressing the packing rings against the radial shoulder; means for holding the compression members in pressing position; a mandrel extending through the packing glands, the packing rings and the radial shoulder; the mandrel having a blind bore opening at one end and an air inflation checkvalve mounted at the one end, and wherein the mandrel, the radial shoulder and the concave section are formed with communicating passages for joining together the blind bore and the air chamber.

According to another aspect of the invention, there is provided an inflatable roller, comprising: a sleeve support consisting of a pair of spaced tubular end sections joined by an intermediate concave section including a straight bore section provided, intermediate the ends thereof, with an annular inner radial shoulder dividing the bore section into a pair of angular corners; packing ring in each of the corners; an elastic sleeve tightly fitting over the outer surfaces of the tubular end sections and having inwardly turned sleeve ends tightly fitting over the inner surfaces of the tubular end sections; the sleeve and the concave section defining, therebetween, an inflatable air chamber; a pair of cup-like compression members, one at each end of and within the support; each compression member having a skirt portion constructed for applying the sleeve ends against the end sections of the sleeve support; the compression members further having axial packing gland portions fitting into the angular corners and applied against the packing rings; a mandrel extending snuggly through the packing-gland portions, through the packing rings and through the radial shoulder; the mandrel having a blind bore and an air-inflation check-valve mounted at the open end of the bore; wherein the mandrel, the shoulder and the concave section are formed with intercommunicating passages joining the blind bore and the inflatable chamber together for sending compressed air from the bore to the chamber, and means operable for holding the compression members toward one another with the packing-gland portions tightly pressed against the packing rings and the skirt portions tightly pressed against the inturned end sections of the elastic sleeve.

A better understanding of the invention will be afforded by the description that follows of two preferred embodiments thereof, having reference to the appended drawings.

DESCRIPTION OF TWO PREFERRED EMBODIMENTS

Figure 2:
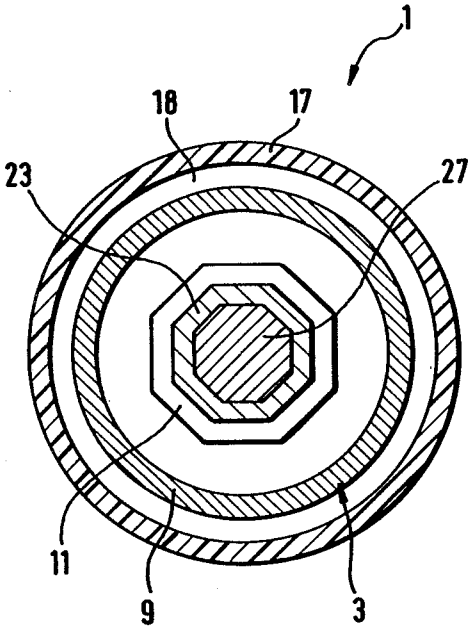
FIG. 2 is a cross-section of the roller shown in FIG. 1, taken along line II—II of FIG. 1.
Figure 1:
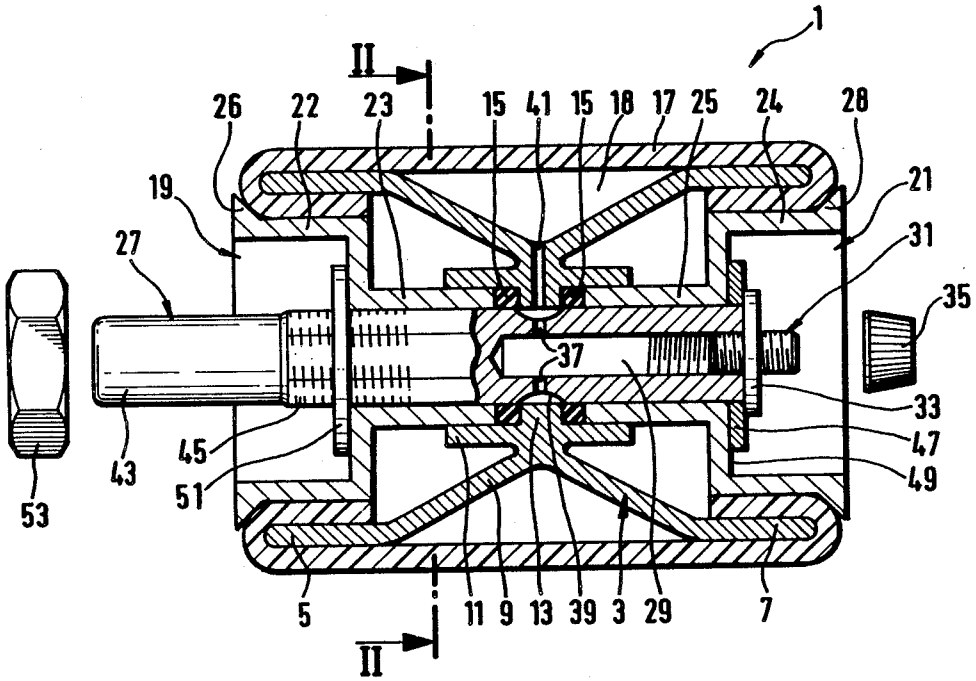
FIG. 1 is a longitudinal cross-section of an improved roller to a first embodiment of the invention.

The roller 1 according to the invention as shown in FIGS. 1 and 2 comprises a sleeve support 3 which consists in a pair of hollow cylindrical or tubular end sections 5, 7, joined by an intermediate V-shaped or otherwise concave section 9, of which the center forms a straight bore section 11 having, between its ends and preferably at its center, a radial shoulder 13. By this construction, the bore section 11 and the shoulder 13 define a pair of angular corners in each one of which is a resilient packing ring 15, preferably a rubber O-ring.

An elastic sleeve 17, of rubber or the like, tightly fits over the outer surfaces of the tubular end sections 5, 7, and it ends are inturned, as shown, to likewise fit tightly over the end sections. it will be noted that the sleeve 17 and the concave section 9 define therebetween an inflatable air chamber 18, as explained further hereinafter. A cylindrical abrasive element such as a grinding belt (not shown) may be fitted over this sleeve.

A pair of cup-like plugs or compression members 19, 21, fit into the ends of the support 3 and are constructed for pressing the inturned ends of the sleeve 17 against the support end sections 5, 7. For this purpose, the compression members 19, 21, are formed with skirt portions 22, 24, of which the outer ends are preferably inwardly bevelled as at 26, 28. Members 19, 21, are also provided, at their centers, with axially extending packing glands 23, 25, which enter into the angular corners of the bore section 11 and press the packing rings 15 against the radial shoulder 13.

As shown, a mandrel 27 extends snuggly through the packing glands 23, 25, through the packing rings 15 and through the radial shoulder 13. It has a blind bore 29 and a conventional air-inflation check-valve 31, of bicycle tube type for instance, which is screwed in its open end. Check-valve 31 has a radial flange 33 which butts against the terminal edge of the mandrel 27 and extends beyond its periphery. After the valve 31 is screwed into position, it is closed by a cap 35. The air chamber 18 is in communication with the blind bore 29, to be thus fed with pressure air, by means of holes 37 through the wall of the mandrel 27, opening into an arcuate groove 39 at the periphery of the mandrel, which groove opens in turn into a channel 41 through the bore section 11 and radial shoulder 13.

Finally and as aforesaid, means are provided for moving the two compression members 19. 21, toward one another for pressing the packing glands 23, 25, tightly against the packing rings 15 and, consequently, against the periphery of the mandrel 27 to insure air-tightness around the round groove 39. By the same token, the skirt 22, 24, and their bevel edges 26, 28, hold the sleeve 17 safely on the end sections 5, 7, of the support 3. It will be appreciated also that moving the compression members 19, 21 forceably toward one another. clamps the mandrel 27, the compression members 19, 21, the resilient sleeve 17 and the support 3 solidly against one another so that they may rotate in unisson when the mandrel 27 is rotated. For this purpose, the latter is extended at one end into a cylindrical stub shaft 43 for mounting onto a chuck of a manual drill, in the usual manner.

In order to insure still a more position drive of the roller 1, the mandrel 27, the packing glands 23, 25, the radial shoulder 13 and the bore section 11 are preferably polygonal in cross section.

In the embodiment of FIG. 1, the mandrel 27 is outwardly threaded at the left end 45, the means than responsible for moving the compression members 19, 21, are as follows.

As said before, the check-valve 31, at the right end of the mandrel 27, has a flange 33 which bears against a washer 47 applied over the bottom 49 of the compression member 21 and loose over the mandrel. At the other end of the mandrel, a washer 51 is likewise loosely mounted over the threaded portion 45 and a nut 53 is screwed on the threaded portion 45. Thus, by screwing the nut 53, the two compression members 19, 21, may be forceably moved toward one another.

Figure 4:
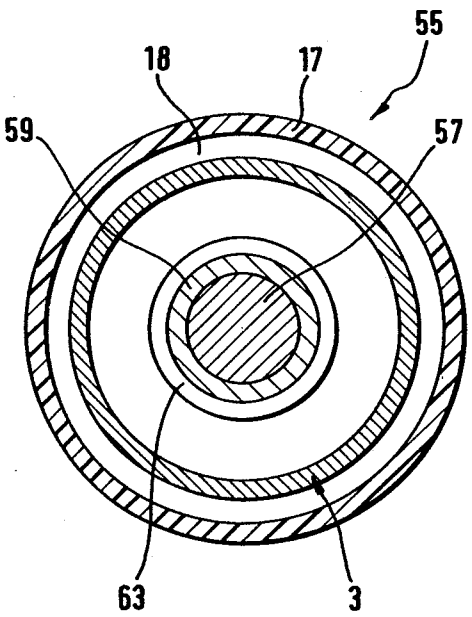
FIG. 4 is a cross-section of the roller shown in FIG. 3, taken along line IV—IV in FIG. 3.
Figure 3:
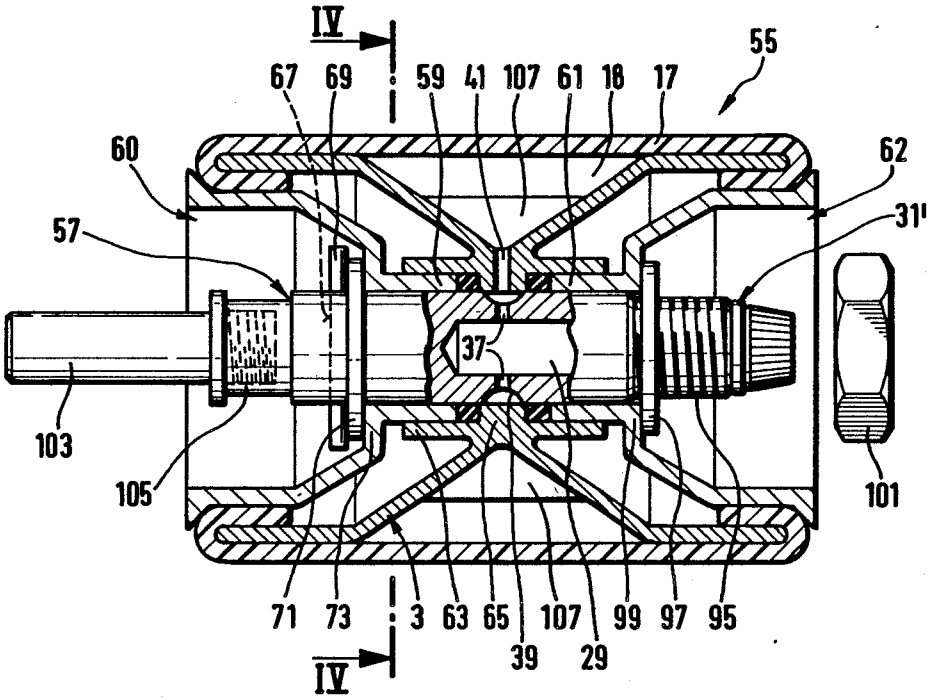
FIG. 3 is a longitudinal cross-section of another roller according to a second embodiment of the invention.
Figure 5:
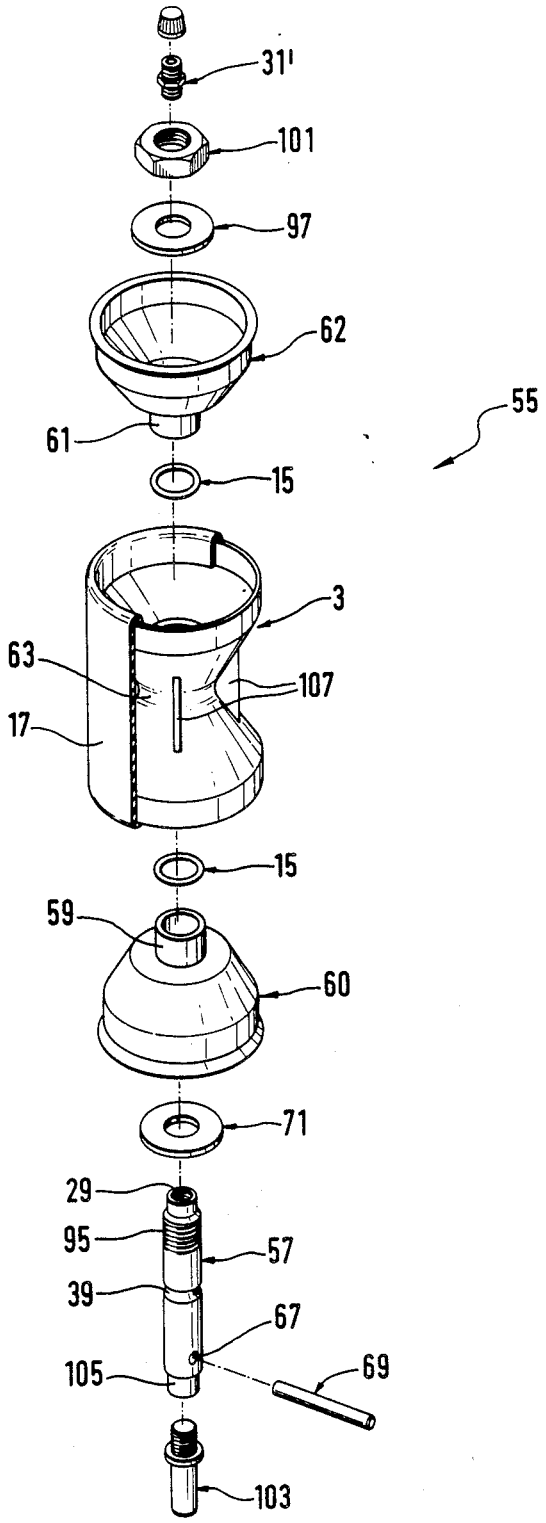
FIG. 5 is an exploded perspective view of the roller shown in FIGS. 3 and 4.

In the other embodiment 55 shown in FIGS. 3, 4 and 5, the configuration of the parts is essentially the same except that the mandrel 57 is circular in cross section throughout its length so that the packing glands 59, 61, of the compression members 60, 62, the bore of the bore section 63 and the radial shoulder 65 are likewise circular in cross section. In this embodiment also, the mandrel 57 has a transverse hole 67 at one end through which extends a pin 69 applied, in use, against a washer 71 itself bearing against the bottom 73. The other end is outwardly threaded at 95 and a washer 97 is slid over it to be pressed against the bottom 99 by a nut 101. Thus, by screwing the latter over the threads 95, the two compression members 60, 62, may be forceably displaced toward one another as in the embodiment of FIGS. 1 and 2.

For rotation, a stub shaft 103 may be removably fixed to a short extension 105 of reduced diameter of the mandrel 57 for securing into the chuck of a manual electric drill.

In order to reinforce the support 3, radially extending wings 107, circumferentially spaced from one another, may be provided in the air chamber 18; channel 41 extending through one such wing.

In this embodiment as in that of FIG. 1, an air-inflation check-valve 31' is also provided into the open end of the blind bore 29 but plays no part in moving the compression members 60, 62, toward one another.

I claim:

1. An inflatable roller for use to mount a cylindrical abrasive element, said roller comprising:

a hollow cylindrical sleeve support having a concave center section including a bore section provided, intermediate its ends, with an inner radial shoulder dividing said bore section into two angular corners;

a packing ring in each of said corners;

an elastic sleeve fitted over said support; said sleeve having ends inturned over the ends of said support; said sleeve and said concave section defining together an inflatable air chamber;

a pair of cup-like compression members fitted into the ends of said support and constructed for pressing said sleeve inturned ends against said support; said members being formed, at their centers, with axial packing glands entering into said bore section and pressing said packing rings against said radial shoulder;

means for holding said compression members in a pressing position against the inturned ends of the sleeve and against the packing rings;

a mandrel extending through said packing glands, said packing rings and said radial shoulder; said mandrel having a blind bore opening at one end and an air inflation check-valve mounted at said one end, and wherein said mandrel, said radial shoulder and said concave section are formed with communicating passages for joining together said blind bore and said air chamber.

2. An inflatable roller for use to mount a cylindrical abrasive element, said roller comprising:

a sleeve support consisting of a pair of spaced tubular end sections joined by an intermediate concave section including a straight bore section provided, intermediate the ends thereof, with an annular inner radial shoulder dividing said bore section into a pair of angular corners;

a packing ring in each of said corners;

an elastic sleeve tightly fitting over the outer surfaces of said tubular end sections and having inwardly turned sleeve ends tightly fitting over the inner surfaces of said tubular end sections; said sleeve and said concave section defining, therebetween, an inflatable air chamber;

a pair of cup-like copression members, one at each end of and within said support; each compression member having a skirt portion constructed for applying said sleeve ends against said end sections of said sleeve support; said compression members further having axial packing gland portions fitting into said angular corners and applied against said packing rings;

a mandrel extending snuggly through said packing-gland portions, through said packing rings and through said radial shoulder; said mandrel having a blind bore and an air-inflation check-valve mounted at the open end of said bore; wherein said mandrel, said shoulder and said concave section are formed with intercommunicating passages joining said blind bore and said inflatable chamber together for sending compressed air from said bore to said chamber, and means operable for holding siad compression members with said packing-gland portios tightly pressed against said packing rings and said skirt portions tightly pressed against said inturned end sections of said elastic sleeve.

3. A roller as claimed in claim 2, wherein said packing rings are elastic O-rings.

4. A roller as claimed in claim 2, wherein said skirt portions of said compression members are formed with outwardly projecting bevel edges pressing against said inturned sleeve ends.

5. A roller as claimed in claim 2, wherein the bore of said straight bore section, said radial shoulder, said packing gland and said mandrel are polygonal in cross-section.

6. A roller as claimed in claim 5, wherein said mandrel is outwardly threaded at one end and said means for holding said compression members comprise:

radial flange means applying the other end of said mandrel against the bottom of the relevant compression member, and a nut threaded over said threaded end of said mandrel and applied against the bottom of the other compression member to draw said compression members toward one another.

7. A roller as claimed in claim 5, wherein said mandrel extends, at said threaded end, into a cylindrical stub shaft for mounting onto a drill chuck for rotation of said grinding roller.

8. A roller as claimed in claim 6, wherein said radial flange means comprise:

a washer over said other end of said mandrel, said washer being applied against the bottom of said compression member, and a flange solid with and radially projecting from said air inflation check-valve, said flange being applied against said washer.

9. A roller as claimed in claim 8, wherein said skirt portions of said compression members are formed with outwardly projecting bevel edges pressing against said inturned sleeve ends.

10. A roller as claimed in claim 2, wherein the bore of said straight bore section, said radial shoulder, said packing gland and said mandrel are circular in cross-section.

11. A roller as claimed in claim 10, wherein said mandrel is outwardly threaded at one end and said means for holding said compression members comprise:

means applying the other end of said mandrel against the bottom of the relevant compression member, and a nut threaded over said threaded end of said mandrel and applied against the bottom of the other compression member to draw said compression members toward one another.

12. A roller as claimed in claim 11, wherein said mandrel extends, at said other end, into a cylindrical stub shaft for mounting onto a drill chuck for rotation of said grinding roller.

13. A roller as claimed in claim 11, wherein said other end of said mandrel has a transverse through hole and said other end-applying-means comprise:

a washer over said other end of said mandrel and applied against the bottom of said relevant compression member, and a pin extending across said through hole, said pin being applied against said washer.

14. A roller as claimed in claim 13, wherein said skirt portions of said compression members are formed with outwardly projecting bevel edges pressing against said inturned sleeve ends.

* * * * *